United States Patent [19]

Lesosky

[11] 4,447,987

[45] May 15, 1984

[54] ADJUSTABLE THRESHOLD AND SILL ASSEMBLY

[75] Inventor: Thomas Lesosky, West Bank, Canada

[73] Assignee: Decor Doors Manufacturing Ltd., Kelowna, Canada

[21] Appl. No.: 245,497

[22] Filed: Mar. 19, 1981

[51] Int. Cl.[3] ..... E06B 1/70

[52] U.S. Cl. ..... 49/468; 49/469

[58] Field of Search ..... 49/467, 468, 469

[56] References Cited

U.S. PATENT DOCUMENTS

| | | | |
|---|---|---|---|
| 3,762,100 | 10/1973 | Kempel | 49/468 |
| 3,774,343 | 11/1973 | Cribben et al. | 49/467 |
| 3,967,412 | 7/1976 | Governale | 49/468 |
| 4,224,766 | 9/1980 | Procton | 49/468 |
| 4,352,258 | 10/1982 | Bursk et al. | 49/468 |

*Primary Examiner*—Kenneth Downey

*Attorney, Agent, or Firm*—Klarquist, Sparkman, Campbell, Leigh & Whinston

[57] ABSTRACT

An adjustable threshold and sill assembly to be used at doorway entrances is disclosed. The assembly comprises a sill (preferably formed from an aluminium alloy material), a water resistant, thermally insulating front of the threshold base member which is preferably resilient but sturdy (high impact polyvinyl chloride material being preferred), means for engaging the threshold base member with the back of the sill, and an adjustable threshold member received by a rectangular channel of the base member and adjustably connected therein for upward and downward movement to vary the level of its upper surface above the open top of the channel.

10 Claims, 3 Drawing Figures

ADJUSTABLE THRESHOLD AND SILL ASSEMBLY

This invention relates to threshold and sill assemblies for doorway entrances.

In today's home construction industry, increasing emphasis is being placed on the energy efficiency of the home. Concurrently, efforts are being made to ensure that this emphasis does not translate into unduly high added costs in a market which is already costly. Hence, in taking steps to improve energy efficiency, it is important to bear in mind the costs which will be involved, including not only the cost of materials, but also the costs of manufacture and labour installation costs.

One part of the home where significant heat losses can occur is over and/or through thresholds of doorways leading into the home. Traditionally, thresholds have been made entirely from wood. Although wood is advantageously a relatively poor heat conductor, it is also susceptible to wear and tear and to water. In cases where a sound fit is achieved at first instance between a door and a wooden threshold over which the door is closed, the sound fit can eventually be lost through wear and tear and through excessive contraction resulting from the drying of wet wood. The net result is to provide a ready pathway for warm interior air to escape beneath the doorway.

Part of the answer has been to provide thresholds which have an adjustable threshold member which can be raised or lowered to enable a sound fit with the door. If the fit deteriorates over a period of time, an adjustment can be made to improve the fit. The idea of an adjustable threshold member has been implemented in combined threshold and sill assemblies. Typically, combined threshold and sill assemblies are fabricated at a remote plant or factory site for shipment and installation at a building site. This technique enables the cost advantages of mass production, and lessens the amount of labour required at the building site. Conventional threshold and sill assemblies in this category often include a single piece extruded from metal such as aluminum. The single piece forms both the sill and a base member of the threshold. However, while there is a manipulative advantage in having the sill and the base member formed from a single piece, such a construction can permit a substantial heat loss to occur through the assembly itself because the metal construction is an excellent heat conductor.

Combined wooden threshold and metallic sill assemblies having a wooden base which acts not only as a base for the threshold member but also as a base for the sill are known. Such assemblies can provide a good thermal break. However, the wood construction is susceptible to the adverse effects of water. Further, wood is a relatively costly construction material to use, particularly for odd-shaped structures such as the structure required to support an adjustable threshold member. Wood is susceptible to cracking and splitting, and it can be relatively difficult to connect a metallic sill and a wooden threshold in a combined assembly.

It is an object of the present invention to provide a new and improved adjustable threshold and sill assembly which is not only easy to manufacture and easy to install, lending itself to prefabricated construction techniques, but also one which is durable and has good thermal insulating characteristics.

In accordance with the present invention there is provided a threshold and sill assembly which comprises a sill, a water-resistant, thermally insulating threshold base member, and an adjustable threshold member. The sill has an elongated front, an elongated back, and a top extending from the front to the back. Preferably, the top has an upward slope from front to back to better enable water runoff. The base member is disposed generally rearward of the sill and extends longitudinally in parallel relationship therewith. It includes a longitudinally extending rectangular channel in which the adjustable threshold member is received and adjustably connected for upward and downward movement to vary the level of its upward surface above the open top of the channel. The threshold and sill assembly further includes means for engaging the front of the threshold base member with the back of the sill.

Preferably, the means for engaging the threshold base member with the back of the sill comprises upper and lower longitudinally extending flanges forming part of the base member which engage cooperating upper and lower longitudinally extending flanges forming part of the back of the sill. Also, the base member is preferably formed from a resilient but sturdy material so as to better facilitate ease of engagement. Not only is this perferred structure easy to manufacture, but it may be implemented in a manner which enables the interconnection of a given threshold base member with any one of a family of possible sill sizes depending upon individual user requirements.

In a preferred embodiment, the sill is a metallic sill the back of which includes a vertically disposed back supporing wall, a back supporting base extending outwardly from the bottom of the back supporting wall, and an overhang merging along one side with the top of the sill and extending outwardly from the top of the back supporting wall over the back supporting base. A lower flange extends upwardly from the back supporting base in parallel relationship with the back supporting wall so as to form an upwardly facing elongated channel between the lower flange and the wall. An upper flange extends downwardly from the overhang in parallel relationship with the back supporting wall so as to form a downwardly facing elongated channel between the upper flange and the wall. In accordance with this embodiment, the threshold base member includes a vertically disposed elongated back supporting wall and a horizontally disposed median wall which merges with the back supporting wall to divide the front supporting wall into an upper portion above the median wall and a lower portion below the median wall. The median wall extends forwardly to merge with a flange which extends downwardly to engage the sill in the upwardly facing elongated channel of the sill. This flange also serves to provide vertical wall support for the front of the base member. The base member also includes a vertically disposed inner wall which extends upwardly from the median wall in parallel opposed relationship with the upper protion of the back supporting wall of the base member so as to form the longitudinally extending rectangular channel for slidingly receiving the adjustable threshold member. A flange extends forwardly from this inner wall, then upwardly engage the sill in the downwardly facing elongated channel of the sill. Preferably, the threshold base member includes a lip which extends forwardly from the inner wall of the base member to overly the overhang of the sill.

The sill is preferably integrally formed from aluminium alloy material—as by extrusion. Also, the threshold base member is perferably integrally formed from high impact polyvinyl chloride plastic material—again as by extrusion.

The present invention consists of only a few parts and is easy to manufacture and easy to install. It provides an effective thermal break at doorway entrances. The water resistant character of the threshold base member makes the assembly less susceptible to the adverse effect of water. Also, the assembly is less likely to move out of adjustment owing to shrinkage of the threshold base member.

The invention will now be described in more detail with reference to the drawings in which.

Figure 1:
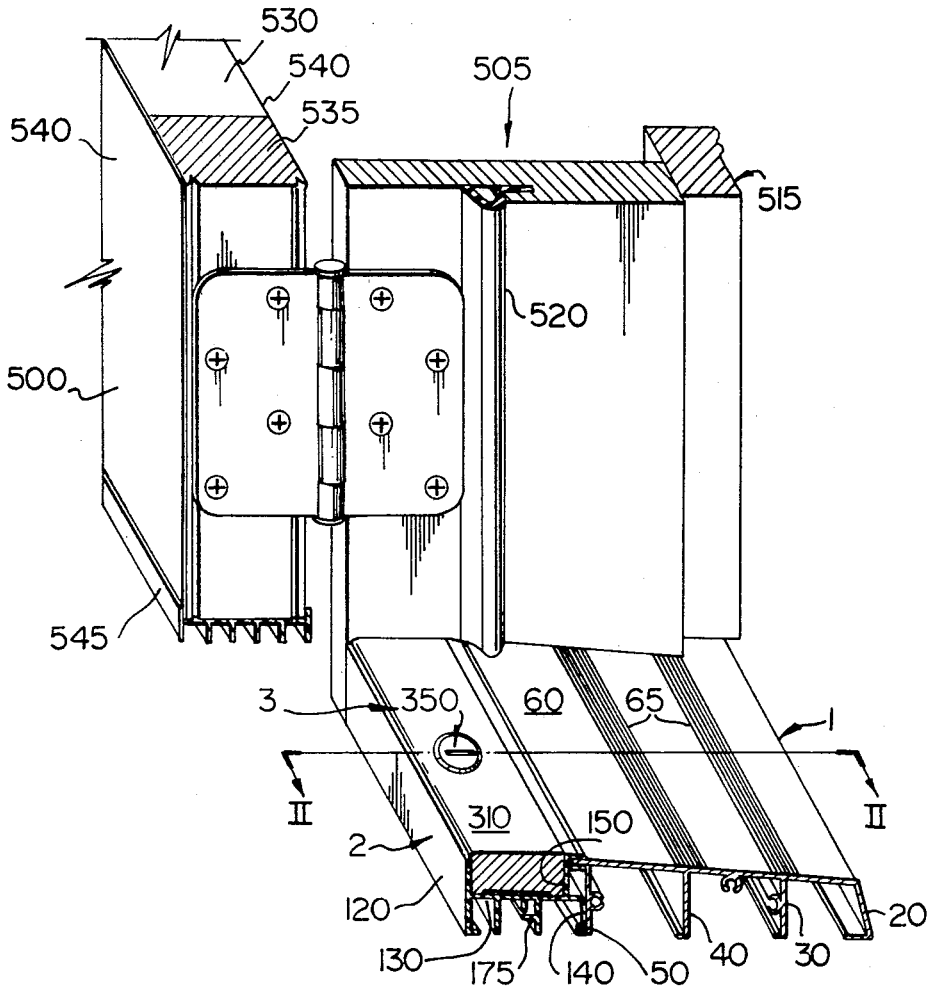
FIG. 1 is a perspective view, partially cut away, showing a threshold and sill assembly in accordance with the present invention when installed in a door frame.
Figure 2:
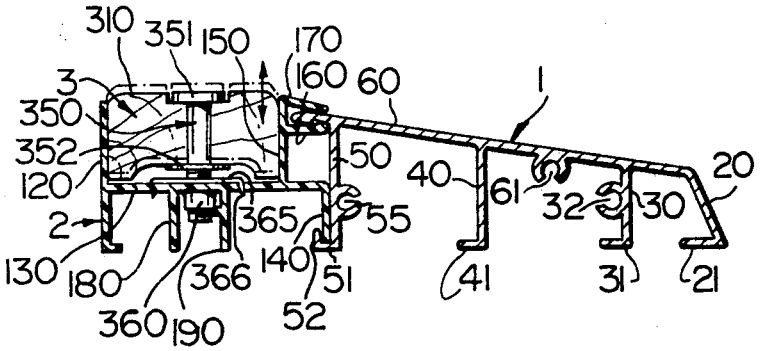
FIG. 2 is a side elevation view taken along section line II—II in FIG. 1.
Figure 3:
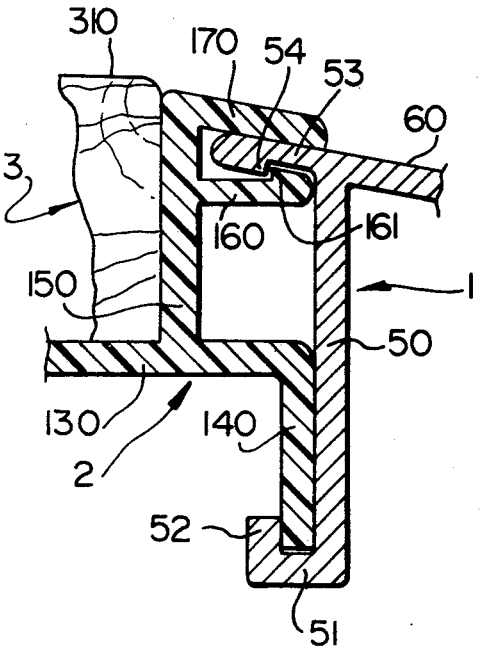
FIG. 3 is an enlarged side elevation view showing in more detail the interconnection between the sill and threshold base member of FIG. 1.

The threshold and sill assembly shown in FIGS. 1, 2 and 3 is one that may typically be used at an entrance doorway for a house. The assembly comprises a sill generally designated 1, a threshold support member generally designated 2, and an adjustable threshold member generally designated 3. When installed, base member 2 and adjustable threshold 3 extend widthwise across the base of the doorway; sill 1 extends towards the outside of the house away from the doorway.

The installation shown in FIG. 1 is a representative installation. Here, the threshold and sill assembly is shown installed in a prefabricated door and frame structure, the structure including a door 500 hinged on a wooden frame member or hinge jamb 505. A decorative moulding (for example, a decorative brick moulding) generally designated 515 extends upwardly along the front of the frame member. Weather stripping 520 is installed on the hinge jamb to provide weather and moisture sealing when the door is in a closed position. The door itself comprises an insulating foam core 530 and a wooden stile 535, all of which is contained by a preformed metal jacket 540. A flexible plastic door sweep 545 is mounted along the base of the door to sweep against adjustable threshold member 3 and provide weather and moisture sealing action when the door is closed.

Sill 1 may be conveniently made in a conventional and well known manner by the extrusion of aluminium alloy material. It includes an elongated front consisting of a front supporting wall 20 and a front supporting base 21, an elongated back consisting of a back supporting wall 50 and a back supporting base 51, and a top 60 which slopes upwardly from the front to the back. As can be seen in FIG. 1, the upper surface of top 60 includes groups of shallow furrows or ribs 65 which provide improved traction. For added support, sill 1 includes two intermediate supporting walls 30 and 40; wall 30 being carried by a supporting base 31, wall 40 being carried by a supporting base 41.

The back of sill 1 includes an overhang 53 which merges along one side with top 60 and extends outwardly from the top of wall 50 over base 51. As can be best seen in the enlarged detail of FIG. 3, upper flange 54 extends downwardly from overhang 53 in parallel relationship with wall 50 thereby forming a downwardly facing elongated channel between flange 54 and wall 50. A lower flange 52 extends upwardly from base 51 in parallel relationship with wall 50 thereby forming an upwardly facing elongated channel between flange 52 and wall 50. Sill 1 also includes screw chases 32, 55 and 61 to facilitate connection on both sides of the sill with a door frame.

Threshold base member 2, is preferably formed in a conventional manner by the extrusion of high impact polyvinyl chloride pastic material. Such a material is sturdy but has a resilient characteristic. The base member includes a vertically disposed elongated back supporting wall 120, and a horizontally disposed median wall 130 which merges with the back wall to divide the back wall into an upper portion above the median wall and a lower portion below the median wall. Median wall 130 extends forwardly to merge with a flange 140 which extends downwardly to engage sill 1 in the upwardly facing elongated channel of the sill. Flange 140 also provides vertical wall support for the base member. Additional vertical support is provided by intermediate walls 180 and 190.

Base member 2 includes a vertically disposed inner wall 150 which extends upwardly from median wall 130 in parallel opposed relationship with the upper portion of back wall 120. As best shown in FIG. 3, a flange consisting of a horizontally disposed portion 160 and a vertically disposed portion 161 extends forwardly from inner wall 150, then upwardly to engage sill 1 in the downwardly facing elongated channel of the sill. A lip 170 extending forwardly from wall 150 above flange portion 160 overlies overhang 53 of the sill when the sill and the threshold base member are engaged as shown the back of the sill being engaged with the front of the base member. Base member 2 also includes a screw chase 175 (see FIG. 1) to facilitate connection on both sides of the member with a door frame.

As can be seen in FIG. 2, inner wall 150, median wall 130, and the upper portion of back wall 120 form a rectangular channel having an open top. Adjustable threshold member 3 is slidingly received within the channel so formed and is adjustably connected therein to vary the level of its upper surface 310 above the open top of the channel. FIG. 2 illustrates member 3 in solid outline for one position of adjustment and in broken outline for a raised position of adjustment.

The connection and desired adjustment of the threshold member is achieved by a plurality of collar screws 350, only one of which is shown in the drawings. In any given case, the total number of collar screws used will depend primarily on the overall width of the threshold (viz. the distance between opposed sides of the doorway in which the assembly is to be installed). For thresholds of the order of 32 to 36 inches in width, it has been found desirable to use four collar screws equally spaced across the width. In the case of thresholds of the order of 65 to 73 inches in width, the use of eight equally spaced collar screws has been found to be desirable.

The lower portion of collar screw 350 is threaded for threadable engagement with a T-nut 360 which protrudes through median wall 130. The T-nut is secured in position by its upper flange 365 which includes downwardly projecting prongs 366 forcibly embedded in median wall 130. Collar screw 350 includes an intermediate flange 352 which engages the bottom of adjustable threshold member 3 to forcibly raise the member as the screw is turned out of T-nut 360. Similarly, cap 351 of collar screw 350 engages a recess in the top of the adjustable threshold member to forcibly lower the member as the screw is turned into T-nut 360.

It will be appreciated that connection between sill 1 and threshold base member 2 can be easily made. Prior to installation in a door frame, sill 1 and threshold base member 2 can be slidingly engaged by aligning the flanges of base member 2 with the upwardly and downwardly facing channels of sill 1, then sliding the two pieces together edgewise. Alternately, base member 2 may be engaged with sill 1 by first seating the bottom of flange 140 in the upwardly facing channel of the sill, then pushing the top of base member 2 forward so that flange portion 161 slides against and under flange 53 and then snaps upwardly into the downwardly facing channel of the sill. This snapping means of connection is enabled by the resilient characteristic of the base member.

It will be appreciated by those skilled in the art that various modifications and changes to the embodiment of the invention which has been described are possible and it is to be understood that the invention is not considered to be limited to such particular embodiment.

I claim:

1. A threshold and sill assembly, comprising:

(a) a sill having an elongated front, an elongated back, and a top sloping upwardly from the front to the back;

(b) a water resistant, thermally insulating threshold base member generally disposed rearward of said sill and extending longitudinally in parallel relationship therewith, said base member including a longitudinally extending rectangular channel having an open top;

(c) means for engaging the front of the threshold base member with the back of the sill; and, (d) an adjustable threshold member received by said channel and adjustably connected therein for upward and downward movement to vary the level of its upper surface above the open top of the channel.

2. A threshold and sill assembly as defined in claim 1, wherein said means for engaging the threshold base member with the back of the sill comprises upper and lower longitudinally extending flanges forming part of said base member for engaging cooperating upper and lower longitudinally extending flanges forming part of the back of said sill.

3. A threshold and sill assembly as defined in claim 2, wherein the sill is formed from aluminium alloy material.

4. A threshold and sill assembly as defined in claim 1, 2 or 3, wherein the base member is formed from a resilient but sturdy material.

5. A threshold and sill assembly as defined in claim 1, 2 or 3, wherein the threshold base member is formed from polyvinyl chloride plastic material.

6. A threshold and sill assembly, comprising:

(a) a metallic sill having an elongated front, an elongated back, and a top sloping upwardly from the front to the back, the back including:

(i) a vertically disposed back supporting wall;

(ii) a back supporting base extending outwardly from the bottom of said wall;

(iii) an overhang merging along one side with the top of the sill and extending outwardly from the top of said wall over said base;

(iv) a lower flange extending upwardly from said base in parallel relationship with said wall so as to form an upwardly facing elongated channel between said lower flange and said wall; and, (v) an upper flange extending downwardly from said overhang in parallel relationship with said wall so as to form a downwardly facing elongated channel between said upper flange and said wall;

(b) a water resistant, thermally insulating threshold base member generally disposed rearward of said sill and extending longitudinally in parallel relationship therewith, said base member including:

(i) a vertically disposed elongated back supporting wall;

(ii) a horizontally disposed median wall merging with said back supporting wall to divide the back supporting wall into an upper portion above the median wall and a lower portion below the median wall, said median wall extending forwardly to merge with a supporting flange which extends downwardly to engage said sill in the upwardly facing elongated channel of the sill;

(iii) a vertically disposed inner wall extending upwardly from said median wall and in parallel opposed relationship with the upper portion of said back supporting wall so as to form a longitudinally extending rectangular channel having an open top; and, (iv) a flange extending forwardly from said inner wall, then upwardly to engage said sill in the downwardly facing elongated channel of the sill; and, (c) an adjustable threshold member received by the rectangular channel of said threshold base member and adjustably connected therein for upward and downward movement to vary the level of its upper surface above the open top of such channel.

7. A threshold and sill assembly as defined in claim 6 including a lip forming part of said base member and extending forwardly from said inner wall to overly the overhang of said sill.

8. A threshold and sill assembly as defined in claim 7, wherein the sill is formed from aluminium alloy material.

9. A threshold and sill assembly as defined in claim 6, 7 or 8, wherein the base member is formed from a resilient but sturdy material.

10. A threshold and sill assembly as defined in claim 6, 7 or 8, wherein the threshold base member is formed from polyvinyl chloride plastic material.

* * * * *